US010702005B2

(12) United States Patent
Bigolin

(10) Patent No.: US 10,702,005 B2
(45) Date of Patent: Jul. 7, 2020

(54) SPORTS SHOE

(71) Applicant: Selle Royal S.p.A., Pozzoleone (Vicenza) (IT)

(72) Inventor: Barbara Bigolin, Asolo (IT)

(73) Assignee: SELLE ROYAL S.P.A., Pozzoleone (Vicenza) (IT)

( * ) Notice: Subject to any disclaimer, the term of this patent is extended or adjusted under 35 U.S.C. 154(b) by 212 days.

(21) Appl. No.: 15/107,265

(22) PCT Filed: Dec. 23, 2014

(86) PCT No.: PCT/IB2014/067263
§ 371 (c)(1),
(2) Date: Jun. 22, 2016

(87) PCT Pub. No.: WO2015/097661
PCT Pub. Date: Jul. 2, 2015

(65) Prior Publication Data

US 2017/0000210 A1 Jan. 5, 2017

(30) Foreign Application Priority Data

Dec. 23, 2013 (IT) ..... VR2013A0295

(51) Int. Cl.
*A43B 3/26* (2006.01)
*A43B 5/14* (2006.01)
(Continued)

(52) U.S. Cl.
CPC ..... *A43B 3/26* (2013.01); *A43B 5/06* (2013.01); *A43B 5/14* (2013.01); *A43B 23/0245* (2013.01);
(Continued)

(58) Field of Classification Search
CPC .. A43B 3/26; A43B 5/14; A43C 1/003; A43C 11/142; A43C 11/16; A43C 11/165
(Continued)

(56) References Cited

U.S. PATENT DOCUMENTS 1,902,780 A 3/1933 Holden et al.
3,729,779 A * 5/1973 Porth ..... A43C 11/16 24/68 SK
(Continued)

FOREIGN PATENT DOCUMENTS

CH 698108 5/2009
DE 29613358 8/1996
(Continued)

OTHER PUBLICATIONS

Office Action for U.S. Appl. No. 15/107,219 dated Aug. 29, 2017 (10 pages).
(Continued)

*Primary Examiner* — Sharon M Prange
(74) *Attorney, Agent, or Firm* — Tutunjian & Bitetto, P.C.

(57) ABSTRACT

The present invention relates to a shoe including a sole as well as an upper that rises up from the sole, the upper including at least two portions that are at least partially mutually displaceable with respect to each other, thereby adjusting the housing size or volume (RZ) for a foot in the shoe, as well as tightening-release means of the mutually displaceable portions, the shoe also including control means of the tightening-release means operable or arranged at the back or at the heel of the shoe.

16 Claims, 5 Drawing Sheets

(51) Int. Cl.

| | |
|---|---|
| ***A43C 1/00*** | (2006.01) |
| ***A43C 11/16*** | (2006.01) |
| ***A43C 11/00*** | (2006.01) |
| ***A43B 5/06*** | (2006.01) |
| ***A43B 23/02*** | (2006.01) |

(52) U.S. Cl.
CPC ..... *A43C 1/003* (2013.01); *A43C 11/008* (2013.01); *A43C 11/16* (2013.01); *A43C 11/165* (2013.01)

(58) Field of Classification Search
USPC ..... 36/50.1, 50.5, 131
See application file for complete search history.

(56) References Cited

U.S. PATENT DOCUMENTS

| | | | | |
|---|---|---|---|---|
| 4,326,320 | A * | 4/1982 | Riedel | A43C 11/008 24/70 SK |
| 4,550,446 | A | 11/1985 | Herman | |
| 4,937,952 | A * | 7/1990 | Olivieri | A43C 11/16 36/118.9 |
| 5,353,524 | A | 10/1994 | Brier | |
| 5,499,459 | A | 3/1996 | Tomaro | |
| 5,595,005 | A | 1/1997 | Throneburg et al. | |
| 5,617,585 | A | 4/1997 | Fons et al. | |
| 5,802,740 | A | 9/1998 | Merck, Sr. | |
| 5,855,079 | A | 1/1999 | Herbert | |
| 5,964,047 | A | 10/1999 | Covatch | |
| 7,140,129 | B2 | 11/2006 | Newson et al. | |
| 7,392,990 | B2 * | 7/2008 | Bussiere | A43B 5/1666 280/11.12 |
| 7,836,612 | B2 | 11/2010 | Agnew et al. | |
| 7,900,379 | B2 | 3/2011 | Lafortune | |
| 8,032,993 | B2 * | 10/2011 | Musal | A42B 3/145 2/418 |
| 8,065,818 | B2 | 11/2011 | Greene et al. | |
| 8,763,209 | B2 * | 7/2014 | Kavarsky | A43C 11/1413 24/68 SK |
| 9,498,023 | B2 | 11/2016 | Craig | |
| 2001/0018805 | A1 | 9/2001 | Basso | |
| 2004/0025374 | A1 | 2/2004 | Basso | |
| 2004/0128863 | A1 | 7/2004 | Hong et al. | |
| 2004/0244221 | A1 | 12/2004 | Hall et al. | |
| 2005/0066544 | A1 | 3/2005 | Beak | |
| 2007/0011912 | A1 | 1/2007 | Clark et al. | |
| 2007/0094892 | A1 | 5/2007 | Craig et al. | |
| 2008/0287832 | A1 | 11/2008 | Collins et al. | |
| 2009/0000152 | A1 | 1/2009 | Agnew et al. | |
| 2009/0018428 | A1 | 1/2009 | Dias et al. | |
| 2009/0100713 | A1 | 4/2009 | Adami et al. | |
| 2009/0199435 | A1 | 8/2009 | Robinson, Jr. et al. | |
| 2010/0086747 | A1 | 4/2010 | Plant | |
| 2010/0236100 | A1 | 9/2010 | Ho | |
| 2011/0258876 | A1 | 10/2011 | Baker et al. | |
| 2012/0004587 | A1 * | 1/2012 | Nickel | A61F 5/0118 602/21 |
| 2012/0011744 | A1 | 1/2012 | Bell et al. | |
| 2012/0030965 | A1 | 2/2012 | Greene et al. | |
| 2012/0144700 | A1 | 6/2012 | Zhao et al. | |
| 2012/0240428 | A1 * | 9/2012 | Knoll | A43B 5/0427 36/50.1 |
| 2013/0014359 | A1 | 1/2013 | Chen | |
| 2014/0090274 | A1 | 4/2014 | Arquilla | |
| 2014/0123449 | A1 * | 5/2014 | Soderberg | A43C 1/003 24/712.1 |
| 2014/0137434 | A1 | 5/2014 | Craig | |
| 2015/0245688 | A1 | 9/2015 | Young | |
| 2015/0376821 | A1 | 12/2015 | McMaster | |
| 2016/0120733 | A1 | 5/2016 | Ishikawa et al. | |
| 2016/0367191 | A1 | 12/2016 | Esposito et al. | |

FOREIGN PATENT DOCUMENTS

| | | |
|---|---|---|
| DE | 29701491 | 5/1998 |
| DE | 202004007174 | 10/2005 |
| EP | 1421868 | 5/2004 |
| WO | 2010096691 | 8/2010 |

OTHER PUBLICATIONS

Office Action for U.S. Appl. No. 15/107,219 dated Jan. 16, 2018 (13 pages).

* cited by examiner

TABLE 1

| | EXTRA SOFT | SOFT | MEDIUM SOFT | MEDIUM HARD | HARD | EXTRA HARD |
|---|---|---|---|---|---|---|
| SHORE 00 | 20 30 35 40 50 | 55 60 | 70 | 80 90 | 95 98 | |
| SHORE A | | 10 20 | 30 40 | 50 60 | 70 80 | 90 95 100 |
| SHORE D | | | | | 22 25 | 35 45 55 65 75 |

FIG. 9

SPORTS SHOE

TECHNICAL FIELD OF THE INVENTION

The present invention relates to a new shoe, in particular, a sports shoe, e.g. for running or cycling.

STATE OF THE PRIOR ART

Up to now, many sports shoes have been proposed with upper and sole of different configuration as well as with different closure types.

US2011258876A1, US2013014359A1, DE29701491U1, US2009199435A1 and EP1421868A1 teach shoes according to the state of the art.

In particular, in sports in which the speed of execution is important, for example for pedalling in cycling or stride/pace in running, it is important that the shoes used oppose the smallest possible impediment.

Naturally, it is also important that the closure of the shoe can be easily carried out, and additionally that it is possible to tighten the upper in an effective manner, so as to comfortably adapt it to the foot of the user according to the needs of the user himself, for example if he uses the shoes for uneven routes, or uphill/downhill routes and/or for running and/or walking.

It is not possible with the current solutions to obtain good aerodynamics in combination with closure and tightening means that are simple and effective.

SUMMARY OF THE INVENTION

Object of the present invention is therefore to provide a new shoe capable of overcoming the abovementioned drawbacks.

Another object of the present invention is to provide a new shoe that can, among other things, be closed or tightened close to the foot of a user in a simple, quick and effective manner, without compromising the aerodynamics of the shoe.

A further object of the present invention is to provide a new shoe that can be comfortably adapted, in an adjustable manner, to the foot of a user.

In accordance with one aspect of the invention, a shoe is provided for according to the present principles.

The present specification refers to preferred and advantageous embodiments of the invention.

BRIEF DESCRIPTION OF THE DRAWINGS

Other characteristics and advantages of the invention will be more evident from the description of embodiments of a shoe, illustrated by way of example in the enclosed drawings in which:

FIG. 9 depicts an exemplary Shore hardness scale shown as Table 1.

In the set of drawings, equivalent components and parts are marked by the same reference numbers.

DETAILED DESCRIPTION OF THE INVENTION

Figure 1:
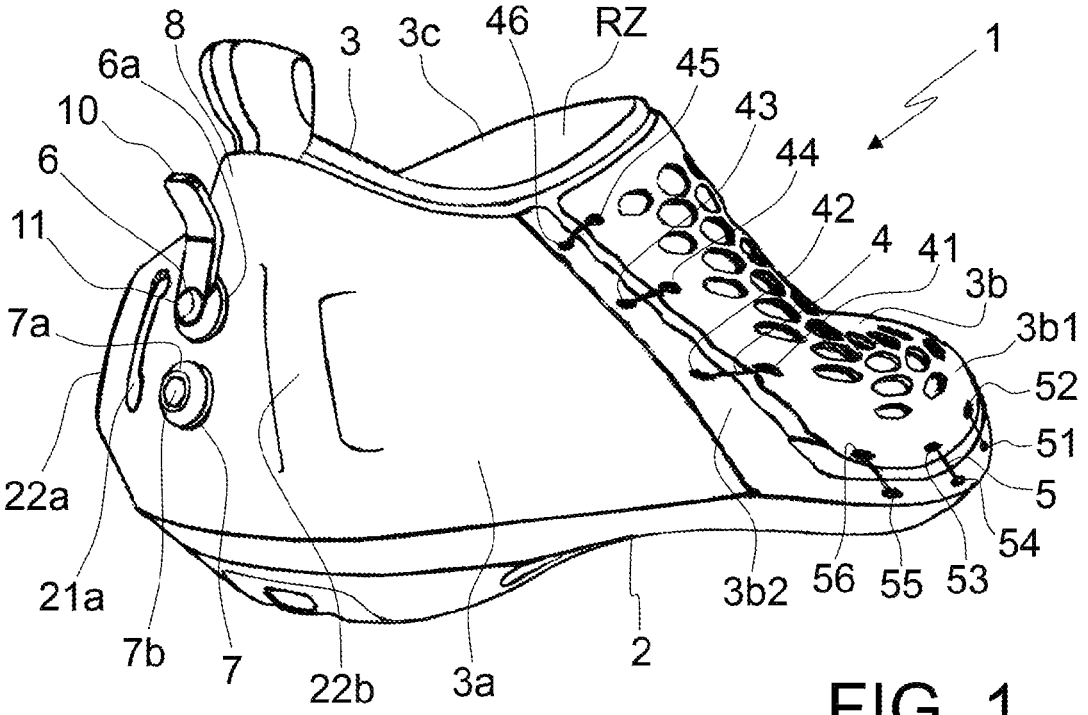
FIG. 1 is an external perspective and back view of a shoe according to the present invention.
Figure 2:
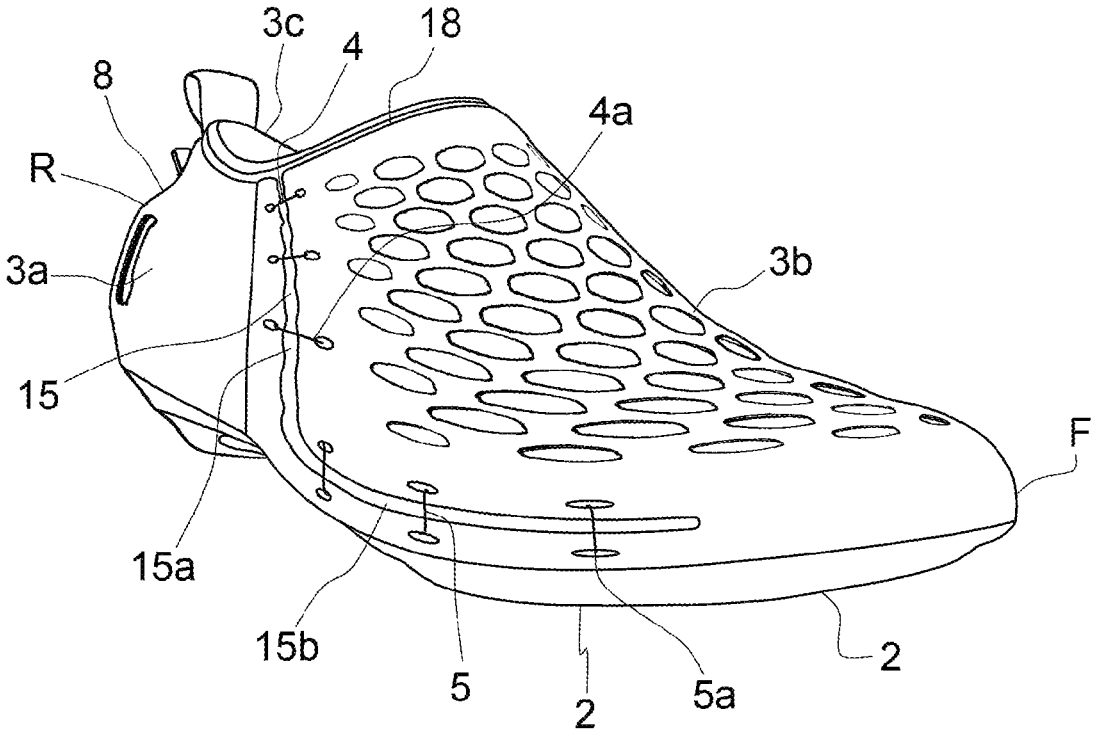
FIG. 2 is an external perspective and front view of the shoe of FIG. 1.
Figure 3:
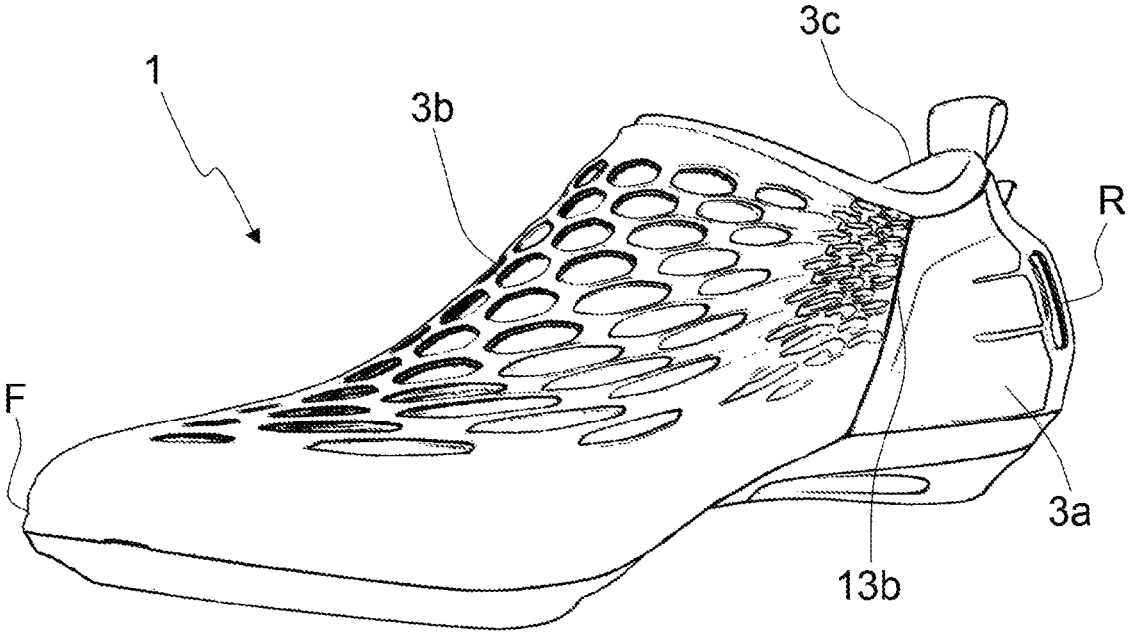
FIG. 3 is an internal perspective and front view of the shoe of FIG. 1.
Figure 4:
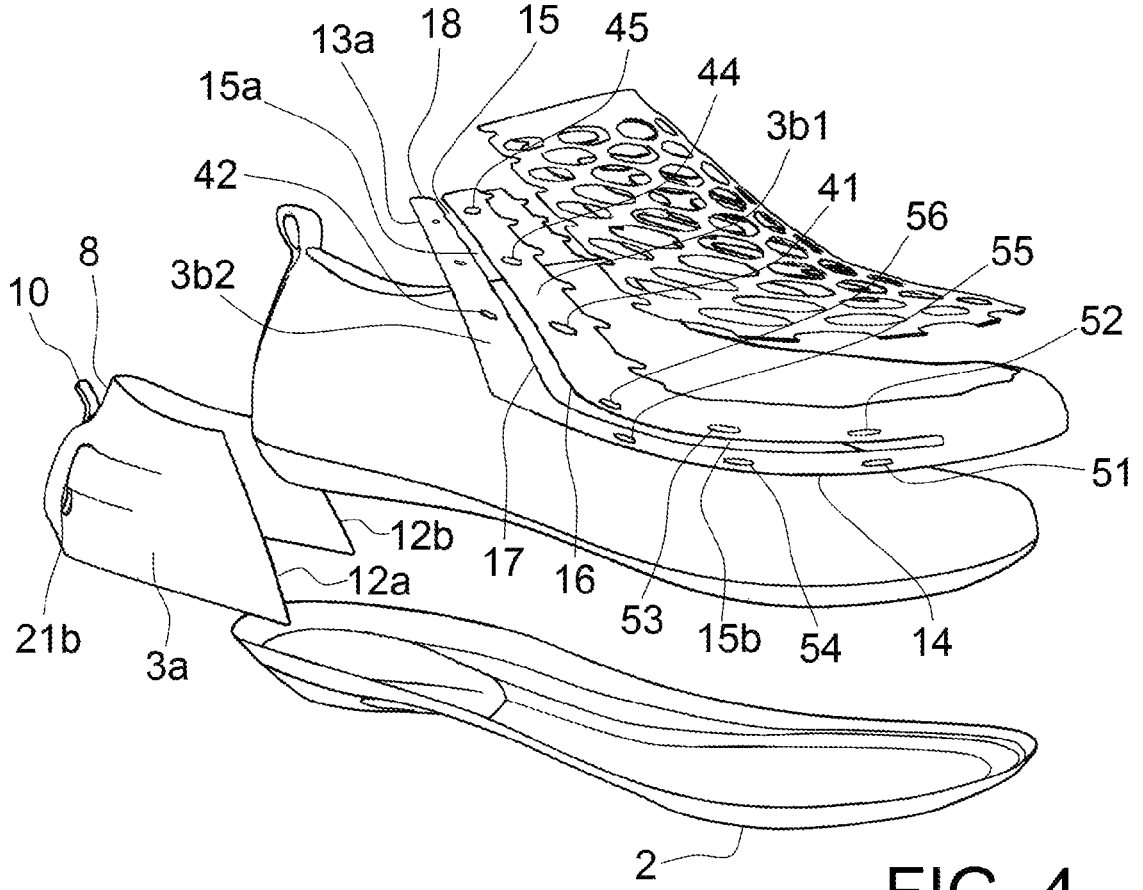
FIG. 4 is an exploded view of a shoe according to the present invention.

With reference to the Figures, a shoe 1 is illustrated, for example for cycling or running comprising a sole 2 as well as an upper 3 that rises up from the sole 2, the upper 3 comprising two or more portions 3*a*, 3*b* at least partially mutually (i.e. with respect to each other) displaceable; one 3*b*, if desired the movable portion, at least partially displaceable with respect to the other 3*a*, if desired the fixed portion, thereby adjusting the housing size or volume RZ for a foot in the shoe 1.

With regard to the mutually displaceable portions, these are displaceable with respect to each other and can both be movable, or one fixed and the other movable with respect to the first.

Preferably, moreover, the upper 3 also comprises a core 3*c* around which the portions 3*a*, 3*b* are mounted, if desired glued or sewn; only the portion 3*a* is mounted around the core 3*c* according to the embodiment obtained in the Figure. If desired, the core delimits the housing volume RZ, while the portions 3*a*, 3*b* are mask components mounted around and covering or enclosing the core 3*c*, in particular the lateral wall of the core 3*c*; in such case, by mutually moving the mutually displaceable portions 3*a*, 3*b*, the shape or configuration of the core 3*c* is modified, thus varying the housing volume RZ. For such purpose, the core 3*c* can be made of soft material, e.g. rubber or similar material, while the portions 3*a*, 3*b* can be made of a material more rigid than the core 3*c*, if desired made of a plastic or composite material. The mutually displaceable portions 3*a*, 3*b* will be described more in detail hereinbelow, according to a non-limiting embodiment.

The shoe then comprises tightening-release means 4, 5 for the mutually displaceable portions 3*a*, 3*b*; such tightening-release means can, for example, comprise one or a plurality of belt or cable elements 4, 5, if desired made of steel, (two according to the illustrated embodiment) with a first end 4*a*, 5*a* fixed to one of the mutually displaceable portions 3*b*, preferably to the movable portion and a second end 4*b*, 5*b* adjustably engageable with the other of the mutually displaceable portions 3*a*, preferably with the fixed portion.

The shoe is then provided with control means 6, 7 for the tightening-release means 4, 5; such control means are operatable or arranged at the back R or, preferably, at the heel 8 of the shoe 1, i.e. that part intended to enclose the heel or rear part of the foot of a user.

Preferably, the control means include:

- at least one component 6 for longitudinal or front (F)-back (R) approach-move apart of the mutually displaceable portions 3*a*, 3*b*, i.e., at least one first approach-move apart component 6 for approaching-moving apart the mutually displaceable portions 3*a*, 3*b* along a longitudinal direction (of the shoe) as well as
- at least one component 7 for lifting-lowering one of the mutually displaceable portions 3*a*, 3*b* with respect to the other 3*b*, 3*a*, i.e., at least one second approach-move apart component 7 for approaching-moving apart one 3*b* of the mutually displaceable portions with respect to other 3*a* along a vertical, in use, direction.

The component 6 for longitudinal approach-move apart is intended to control the tightening-release means 4 for tightening, in the front F—back R direction, the mutually displaceable portions 3*a*, 3*b*, so as to engage the core 3*c* (if provided) from the front F towards the back R or vice versa. Preferably, the approach-move apart component 6 is intended to move the movable portion 3*b* or part thereof towards the back R and towards the fixed portion 3*a* so as to tighten the core 3*c*, and more particularly the lateral wall thereof, or towards the front F or away from the fixed portion 3*a* so as to allow a widening of the core 3*c* and more particularly of the lateral wall thereof.

The lifting component 7 is instead intended to control the tightening-release means 5 so as to vertically and mutually tighten the two portions or parts thereof 3*a*, 3*b* and, if the core 3*c* is provided, to tighten the latter by means of the portions 3*a*, 3*b* from bottom to top or vice versa. Preferably, the lifting component 7 is intended to move the movable portion 3*b* or part thereof downward and towards the fixed portion 3*a*, so as to tighten the core 3*c*, e.g. the tip or a front part thereof, or upward and away from the fixed portion 3*a*, so as to release the core 3*c*, e.g. the tip and a front portion of the core 3*c*.

Still more preferably, the control means comprise at least one pinion component 6, 7 mounted on one of the mutually displaceable portions, if desired on a fixed portion 3*a*, as well as a rack element 9*a*, 9*b* constrained on one side to a respective cable element 4, 5 fixed to the other of the mutually displaceable portions 3*b*, and on the other side engageable by means of one or a respective pinion component 6, 7. A first end of a rack element 9*a*, 9*b* can be fixed to a respective cable element 4, 5 for example via gluing, welding or by means of insertion and locking of a cable element 4, 5 in a slot formed in such first end. The other or second end of the rack element 9*a*, 9*b* can be free, while an intermediate portion of the rack element is slidably mounted in meshing engagement with a respective pinion component 6, 7.

The pinion component 6, 7 can be rotatably mounted around a substantially horizontal axis or in the front F-back R direction, e.g. transverse to the upper and from the outside towards the inside thereof, while the rack element(s) 9*a*, 9*b* can have preferably substantially horizontal trim and be extended in a direction around the housing volume RZ.

A pinion component 6, 7 can be rotatably mounted in the heel 8 of the shoe 1, while a respective rack 9*a*, 9*b* is slidably guided in meshing engagement with a respective pinion element 6, 7. For such purpose, the fixed portion 3*a* can have, overall or in part, a closed shell-like body delimiting a suitably-shaped zone for the sliding and guiding of the rack element(s) 9*a*, 9*b*, in which also the pinion element/elements 6, 7 projects/project. If desired, the shell-like body of the fixed portion 3*a* can comprise projecting parts or parts in relief delimiting the sliding and guiding zone for the rack element(s) 9*a*, 9*b*.

Advantageously, the cable element/elements 4, 5 engages/engage the movable portion 3*b* at a plurality of zones, such that by controlling the operation of the control means 6, 7, an overall and non-localised tightening or release is determined of the two mutually displaceable portions 3*a*, 3*b*.

For such purpose, a cable element 4 can be constrained to the movable portion 3*b* in an intermediate or lower zone thereof and returned one or more times (three according to the illustrated embodiment) between movable portion 3*b* and fixed portion 3*a* or between separated sections 3*b*1 and 3*b*2 of one of such portions 3*b*. This can for example be obtained by means of the passage or subsequent return of the cable element 4 in eyelets 41, 42, 43, 44, 45, 46 formed in such portions, 3*a*, 3*b* or in sections 3*b*1, 3*b*2 of a portion 3*b*, such eyelets being arranged at different levels of the upper and of one or both portions 3*a*, 3*b* until the cable element 4 reaches or projects at the top of a rear edge 13*a* of the movable portion 3*b*, thus a front edge 12*a* of the fixed portion 3*a* and from here is conveyed to the control means, hence, if provided, to the respective rack element 9*a*. If desired, in the fixed portion 3*a* and/or in the movable portion 3*b*, insertion grooves can be provided for the guiding and sliding of the cable element 4.

The cable element 4 can constitute a component 6 for longitudinal or front (F)-back (R) approach-move apart of the control means.

A cable element 5 can also be constrained to the movable portion 3*b* in a front zone thereof and be returned one or more times (three according to the illustrated embodiment) between movable portion 3*b* and fixed portion 3*a* or between sections 3*b*1, 3*b*2 of one of such portions 3*b* by means of passage of the cable element 5 in respective eyelets 51, 52, 53, 54, 55, 56 arranged at zones with different longitudinal or front F—back R position of the upper, until a rear edge 13*a* of the movable portion 3*b* is reached and from here be conveyed towards a front edge 12*a* of the fixed portion 3*a* and then to the control means, hence if provided to the respective rack element 9*b*. Also in such case, if desired in the fixed portion 3*a* and/or in the movable portion 3*b*, grooves can be provided for the insertion and sliding of the cable element 5.

The cable element 5 can represent a component 7 for the mutual lifting-lowering of the mutually displaceable portions 3*a*, 3*b*.

According to the embodiment illustrated in the Figures, two pinion components 6, 7 are provided for, each intended to control the sliding of a respective rack element 9*a*, 9*b*, each rack element 9*a*, 9*b* being fixed to a respective cable element 4, 5. In such case, the two rack elements 9*a*, 9*b* can be substantially horizontal.

According to such embodiment, the first cable element 4 is upper during use and extends starting from the respective rack element 9*a* to a front edge 12*a*, if desired at the top of such edge, of the fixed portion 3*a* and from here it is extended beyond the fixed portion 3*a* until it engages the movable portion 3, if desired at the top thereof.

One or more pinion components 6, 7 can also have a head 6*a*, 7*a* outside or projecting outside the upper 3, in particular at the heel 8; a toothed wheel or the like (not illustrated in the drawings) or a stem on which a toothed wheel is mounted can also extend from the head outside 7*a*.

Advantageously, the control means also comprise a control lever 10 for controlling the rotation of the pinion component 6, which control lever can be elastically loaded. Alternatively, in the head outside 7*a* of a pinion component 7, an engagement seat 7*b* can be delimited for an actuation tool, e.g. a screwdriver or Allen spanner.

Preferably, the control lever 10 is elastically loaded, but it is disengaged from the respective pinion component 6 after having controlled the rotation thereof, such that, after a respective angular movement or actuation thereof with consequent rotation of the pinion component 6, it returns with substantially vertical position and free grip portion that is extended upward. The control lever 10 can, therefore, be a kind of "ratchet" or "ratchet key" with position return spring and allows an adjustment with releases with fixed pitch of the pinion component 6. Due to such expedient, the user always knows the position of the lever 10 (e.g. substantially vertical) and is able to reach it and control appropriately during the execution of a sport, e.g. during pedalling.

Advantageously, the control lever 10 is substantially curved, e.g. helical, so as to provide an easy grip surface for the user, e.g. for a thumb thereof.

Figure 5:
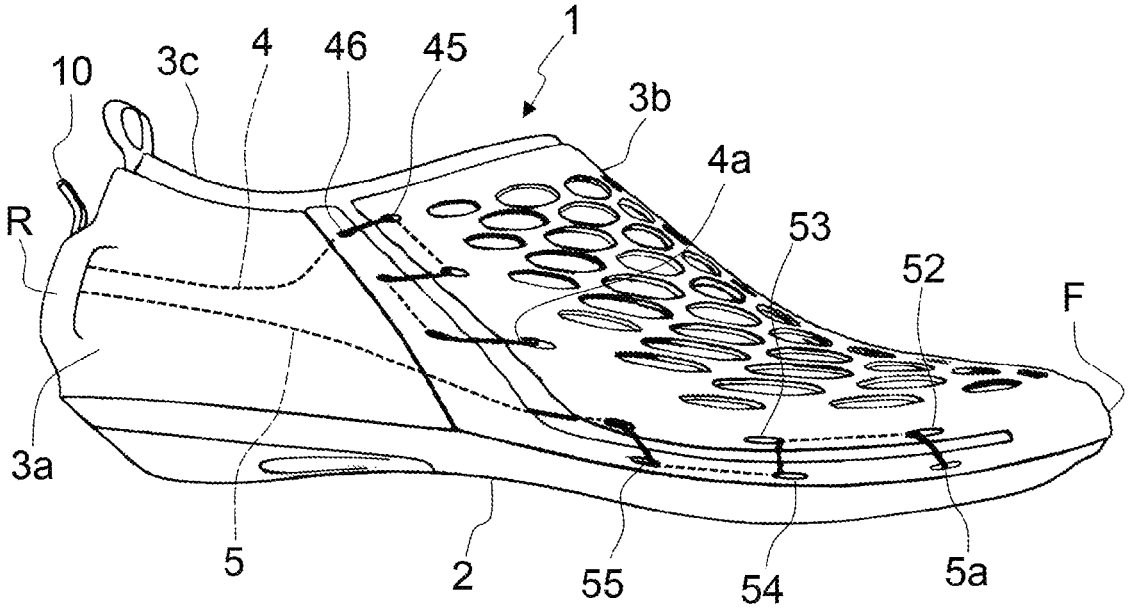
FIGS. 5 and 6 are side views with transparent parts of the shoe of FIG. 1 in respective operative positions.
Figure 6:
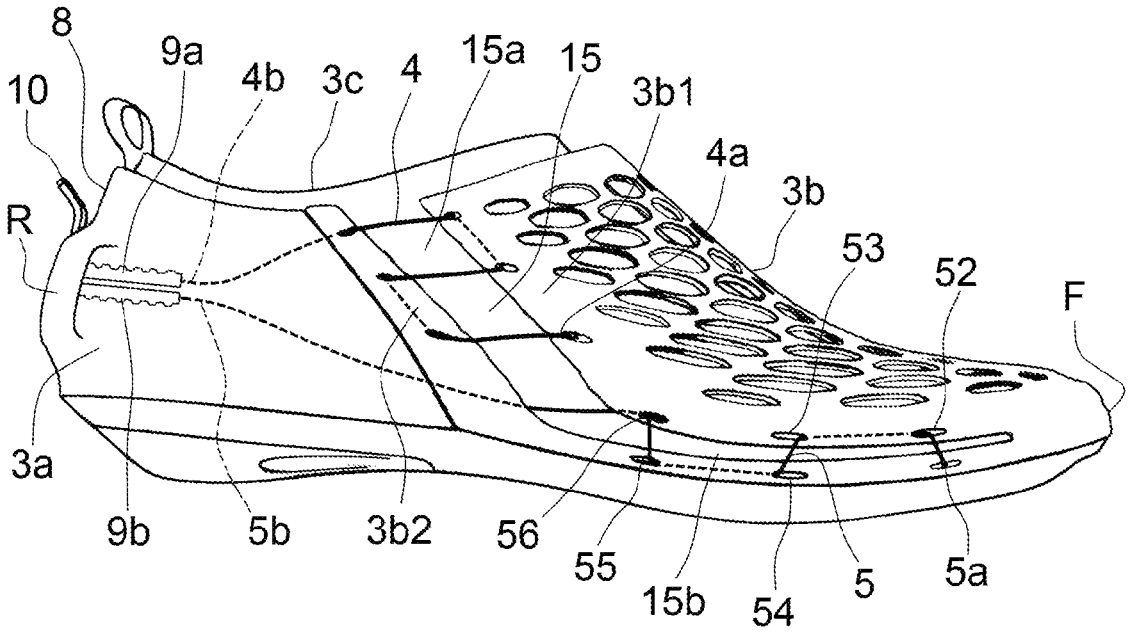
Figure 7:
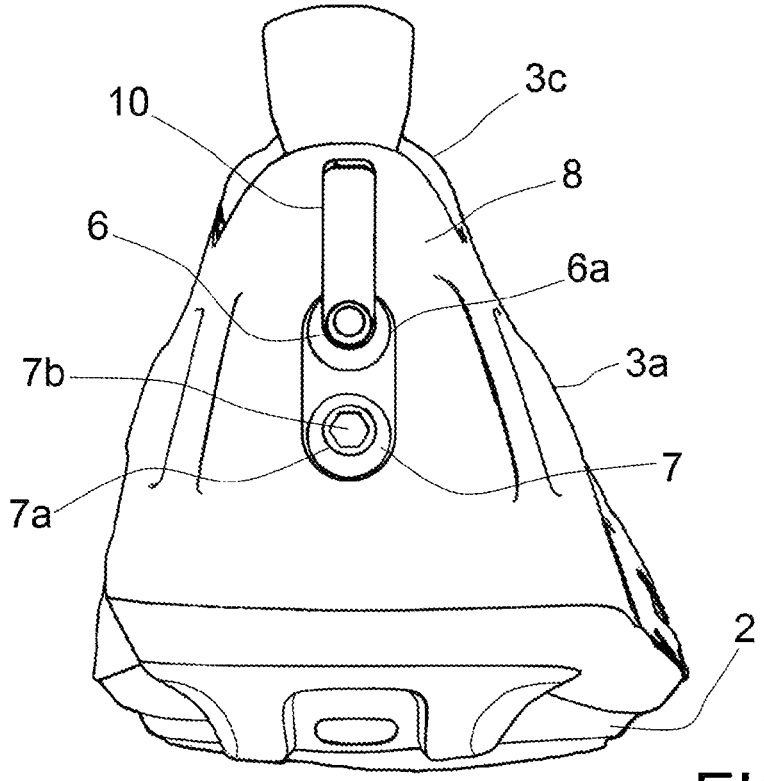
FIG. 7 is a back view of the shoe of FIG. 1.
Figure 8:
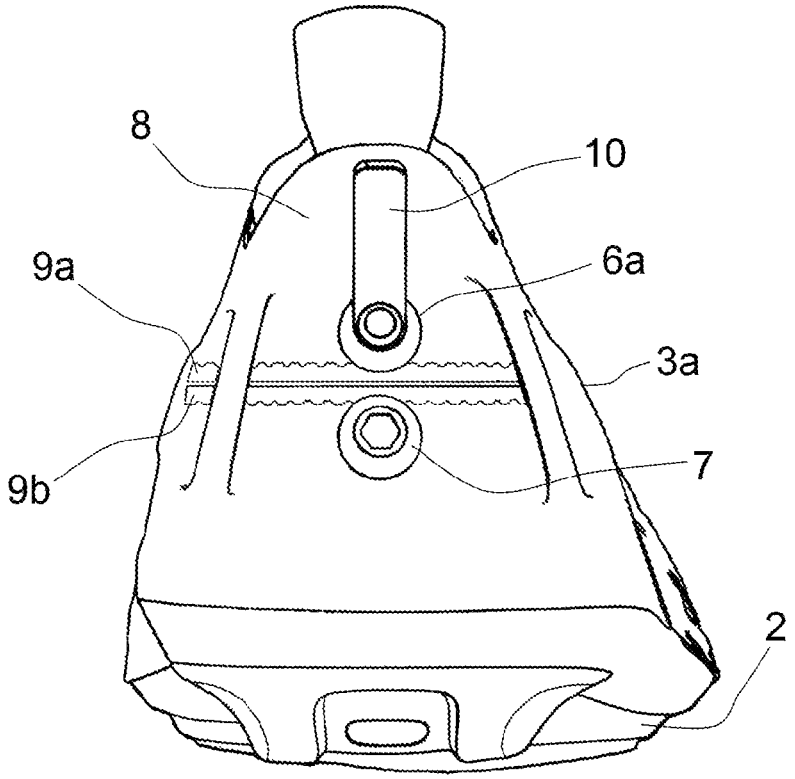
FIG. 8 is a back view of the shoe of FIG. 1 with transparent parts.

In addition, a pinion component 6 can be displaceable between a rest position (in which the mutually displaceable portions 3*a*, 3*b* are arranged as in FIG. 6 and hence are loosely constrained to each other so as to not reduce the housing size or volume RZ) and a work position (in which the mutually displaceable portions 3*a*, 3*b* are arranged as in FIG. 5 and are rigidly constrained in a manner so as to reduce—or adapt to the specific size of the foot of the user—the housing size or volume RZ) in which it is rotated with respect to the rest position, and a release button 11 is provided for the pinion 6 intended to take such pinion back into rest position.

With regard to the mutually displaceable portions 3*a*, 3*b*, these can comprise a substantially front tongue part 3*b* as well as a lateral-rear part 3*a*, if desired U-shaped, e.g. with section increasing downward, which can be constrained to each other.

The tongue part 3*b* can have two rear edges 13*a*, 13*b*, one 13*a* on one side or inner side of the shoe and the other 13*b* on the other side or outer side of the shoe, fixed to the lateral-rear part 3*a* or better yet to respective front edges 12*a*, 12*b* (one on one side and the other on the other side of the fixed portion 3*a*) as well as a lower edge 14 fixed to the sole 2. In the tongue part 3*b*, preferably on the outer side of the shoe, i.e. the side during use directed away and not towards the other shoe worn by the user, a groove 15 can be formed so as to delimit two inner edges 16, 17 therein, each belonging to the two sections 3*b*1, 3*b*2, while the tightening-release means 4, 5 for the mutually displaceable portions are intended to tighten-release the inner edges 16, 17 of the tongue part 3*b*, and consequently to tighten-release one section 3*b*2 of the movable portion 3*b* with respect to the other section 3*b*1 and thus with respect to the fixed part 3*a*.

The tongue part 3*b* can, for example, be made of multiple layers or components, each made of a material with different hardness with respect to the others.

For such purpose, the materials are usually classified as follows (see also table 1 shown in FIG. 9).

Extra soft: Shore 00 from 20 to 50 (e.g. chewing gum and racquetball balls),

Soft: Shore 00 from 50 to 70 (e.g. rubber band),

Medium soft: Shore 00 from 70 to 80 (e.g. pencil eraser),

Medium hard: Shore 00 from 80 to 95 (e.g. tyre),

Hard: Shore 00 higher than 95 or Shore D from 22 to 35 (e.g. the heel of a shoe), Extra hard: Shore D from 35 to over 75 (e.g. wheels of shopping carts or rigid material caps).

The groove 15 can extend from the free upper edge 18 of the tongue portion 3*b* up to the tip thereof. More particularly, the groove 15 can have a first section 15*a* that is extended from the upper edge 18 and with slightly oblique progression or with lower end in a more advanced position or proximal to the front F with respect to the upper end, and then a second section 15*b* substantially horizontal or parallel to the sole 2.

In such case, the cable element 4 can be returned between inner edges 16, 17 of the movable portion 3*b* at the first section 15*a*, while the cable element 5 can be returned between inner edges 16, 17 of the movable portion 3*b* at the second section 15*b*.

With a shoe according to the present invention, as will be understood, it is possible to simply and effectively adapt the shoe to the foot of the user.

More particularly, the user wears the shoe with tightening-release means in rest or released position (see FIG. 6) and then operates on the tightening-release means 4, 5 by means of the control means, so as to bring them into work or tightening position (see FIG. 5) and thus adapt the shoe to his foot. For such purpose, according to the illustrated embodiment, by operating on a pinion component 6, 7 so as to move it via rotation (manually by means of a lever 10 or with a tool engageable in a head 7*b*) from a rest position to a work position, then the pinion component will control the translation or sliding of a respective rack 9*a*, 9*b* and thus of the respective cable element 4, 5, which would involve a tightening of the movable portion 3*b* with the fixed portion or with one section 3*b*1 of the movable portion with respect to the other section 3*b*2 and thus with respect to the fixed portion 3*a*.

In particular, if the control means comprise both a component 6 for longitudinal approach-move apart and a lifting-lowering component 7, then the user, after having put on the shoe, can operate, e.g. on the lifting-lowering component 7, by varying the volume of the shoe and subsequently operate on the approach-removal component 6 so as to modify the blocking of the foot by means of increasing or decreasing the longitudinal pressure applied by the tongue part 3*b*.

According to such variant, the combination of the two components 6 and 7 allows perfectly or ergonomically mating the upper to different feet, thus preventing undesired displacements of the foot with respect to the shoe and irritating pressure points or zones on the foot.

By using two components 6 and 7 as stated above, it is possible, if desired, to adjust the volume of the upper by means of the component 7 only once; such volume can for example change when socks with different thicknesses are used, and subsequently it is possible to adjust or micro-adjust the tightening of the shoe on the foot, which may have to be varied during use.

In addition, by providing for the control means on the back or on the heel of the upper, as will be understood, the same means will not compromise the aerodynamics of the shoe, in particular and in combination with an upper made as outlined above.

The heel 8 of the shoe 1 can then comprise at least one channel 21*a*, 21*b*, suitable for channelling the air that hits the upper 3 of the shoe 1 during the execution of the pedalling, in order to further reduce the aerodynamic resistance of the same.

More in detail, the heel 8 can comprise a first channel 21*a* and a second channel 21*b* suitable for channelling the air that hits the upper 3.

The first channel 21*a* and the second channel 21*b* can be arranged, respectively, on the outer side and on the inner side of the heel 8.

The channels 21*a* and 21*b* are defined for example by respective bridges 22*a*, 22*b* shaped by the heel 8 itself and substantially vertically arranged with respect to the support surface of the sole 2 of the shoe 1.

The section of the channels 21*a*, 21*b* is thus substantially narrow and vertically elongated, still with reference to the support surface of the sole 2.

The section of the channels 21*a*, 21*b* can vary from one end to the other thereof, in a manner so as to obtain the desired air flow conditions: for example, converging sections can give rise to accelerations of the air during its travel along the channels 21*a*, 21*b*, with advantageous effects in conveying the air towards the zone of the heel 8. The bridges 22*a*, 22*b* can also protect the control means 6, 7—in particular the zone of the heads 6*a*-7*a*—from possible impact that could damage them or accidentally modify the position set by the user.

Modifications and variants of the invention are possible within the protective scope defined by the claims.

Thus, for example, two grooves 15 could be provided for, each extended on a respective side of the shoe, and tightening-release means could be provided that are intended to tighten-release the inner edges of both grooves, such means controlled by respective control means. For such purpose, one or more racks could be provided, controlled by suitable pinions, each rack connected to respective cable elements operating on a groove on one side of the shoe, and one or more racks could be provided that are controlled by suitable pinions, each rack connected to respective cable elements operating on a groove on the other side of the shoe.

In addition, the fixed portion 3*a* and the movable part 3*b* could be made in a different manner, e.g. the movable portion could have a lower edge fixed to the upper, a rear edge fixed to the fixed portion and the other rear edge not constrained to the fixed portion 3*a* and approachable or tightenable thereto by means of the tightening-release means.

The invention claimed is:

1. A shoe comprising:

a sole as well as an upper that rises up from said sole, said upper comprising at least two portions at least partially mutually displaceable with respect to each other thereby adjusting the housing size or volume (RZ) for a foot in said shoe, and tightening-release means of said mutually displaceable portions, said at least two portions comprising a lateral rear part and a tongue part, said tongue part comprising two sections on one side of the shoe defining a single groove therebetween, said single groove comprising a first section intersecting with a second section, wherein the first section has an oblique progression and the second section is substantially horizontal to the sole, wherein said two sections of the tongue part are directly affixed to each other on the other side of the shoe; and control means of said tightening-release means arranged at the back of said shoe, said control means comprising at least one first approach-move apart component for approaching-moving apart said mutually displaceable portions at the first section along a longitudinal direction, and at least one second approach-move apart component for approaching-moving apart one of said mutually displaceable portions with respect to the other at the second section along a vertical, in use, direction.

2. The shoe according to claim 1, wherein said first approach-move apart component is intended to cause said tightening-release means to tighten-release said mutually displaceable portions along the longitudinal direction, while said at least one second approach-move apart component is intended to control said tightening-release means to vertically mutually tighten-release said mutually displaceable portions.

3. The shoe according to claim 1, wherein said tightening-release means comprise at least one cable element having a first end fixed to one of said mutually displaceable portions and a second end adjustably engageable with the other of said mutually displaceable portions.

4. The shoe according to claim 3, wherein said mutually displaceable portions comprise a fixed portion and a movable portion at least partially displaceable with respect to said fixed portion and in that said cable element engages said movable portion at a plurality of zones, so that by controlling the operation of said control means an overall and non-localised tightening or release of said two mutually displaceable portions is obtained.

5. The shoe according to claim 4, wherein said at least one cable element is constrained to the movable portion and returned one or more times between movable portion and fixed portion or between sections of one of said mutually displaceable portions.

6. The shoe according to claim 5, further comprising eyelets arranged at different levels or at areas with different longitudinal or front (F)-back (R) position of said upper and in that said at least one cable element is returned through subsequent passing or return of said at least one cable element in said eyelets.

7. The shoe according to claim 3, wherein said control means comprise at least one pinion component mounted on one of said mutually displaceable portions as well as at least one rack element constrained to said at least one cable element fixed to the other of said mutually displaceable portions.

8. The shoe according to claim 7, wherein said at least one pinion component is mounted for rotation in the heel of said shoe, whereas said at least one rack element is slidably guided in meshing engagement with said at least one pinion element.

9. The shoe according to claim 8, wherein said control means comprise at least one control lever for controlling the rotation of said at least one pinion component.

10. The shoe according to claim 9, wherein said control lever is elastically loaded.

11. The shoe according to claim 7, wherein said at least one pinion component has a head outside of or projecting outside of said sole and delimiting an engagement seat for an actuation tool.

12. The shoe according to claim 7, wherein said at least one pinion component is displaceable between a rest position and a work position in which said at least one pinion component is rotated with respect to said rest position, and in that it comprises at least one release button of said at least one pinion component intended to take said at least one pinion component back into said rest position.

13. The shoe according to claim 1, wherein said tongue part has two rear edges fixed to said lateral-rear part as well as a lower edge fixed to said sole, and in that the single groove is formed in said tongue part so as to delimit two inner edges in said tongue part, whereas said tightening-release means of said mutually displaceable portions are intended to tighten-release said inner edges of said tongue part.

14. The shoe according to claim 13, wherein said groove extends from a free upper edge of said tongue portion up to the tip thereof.

15. The shoe according to claim 13, wherein said tightening-release means comprises at least one cable element returned between said two inner edges of said tongue part.

16. The shoe according to claim 1, wherein said upper comprises a core around which said mutually displaceable portions are mounted, said core delimiting said housing volume (RZ).

* * * * *